United States Patent [19]

Duhon

[11] Patent Number: 4,517,876

[45] Date of Patent: May 21, 1985

[54] CYMBAL SUPPORT

[76] Inventor: Dane J. Duhon, 2601 Dusky Rose, Pasadena, Tex. 77502

[21] Appl. No.: 611,073

[22] Filed: May 17, 1984

[51] Int. Cl.[3] ..... G10D 13/06; G10G 5/00

[52] U.S. Cl. ..... 84/422 R; 84/421

[58] Field of Search ..... 84/421, 422

[56] References Cited

U.S. PATENT DOCUMENTS 2,417,972 3/1947 D'Arcy ..... 84/422 H 4,216,696 8/1980 Alexis ..... 84/422 H

FOREIGN PATENT DOCUMENTS 1382432 1/1975 United Kingdom ..... 84/422 H

*Primary Examiner*—Lawrence R. Franklin

*Attorney, Agent, or Firm*—Harvey B. Jacobson

[57] ABSTRACT

An upright first tubular member is provided including base structure at its lower end for support from a horizontal surface. A second tubular member is slidably telescoped in the first tubular member and includes an upper end projecting above the upper end of the first tubular member. A lower centrally apertured and upwardly facing cymbal is mounted from the upper end of the second tubular member for universal canting relative thereto and an upstanding support rod is slidably received through the second tubular member and projects upwardly through the lower cymbal and above the upper end of the second tubular member. An upper downwardly facing cymbal is mounted on the upper end of the rod above and opposing the lower cymbal and structure is connected between the first tubular member and the rod yieldingly biasing the rod and the upper cymbal toward a static upper position spaced above the lower cymbal. Foot operable structure is operatively connected between the first and second tubular members and is operative to variably stationarily longitudinally position the second tubular member relative to the first tubular member, whereby the static vertical spacing between the central areas of the cymbals may be variably adjusted. Further, foot treadle structure is operatively connected between the first tubular member and the rod for selectively and variably downwardly displacing the rod, and thus the upper cymbal, relative to the lower cymbal.

10 Claims, 6 Drawing Figures

CYMBAL SUPPORT

BACKGROUND OF THE INVENTION

Conventional cymbal stands of the "high hat" type include an upright tubular member from whose upper end a lower upwardly facing centrally apertured cymbal is mounted for universal canting. A vertical rod is telescoped in the tubular member and projects above the latter, through the lower cymbal and has an upper downwardly facing cymbal mounted thereon opposing the lower cymbal with the lower end of the rod connected to a spring-biased foot treadle. The spring pressure upwardly biases the rod to a static position thereof with the upper cymbal spaced at a predetermined height and the treadle may be used to downwardly displace the upper cymbal from its upper static limit position toward the lower cymbal. In addition, the lower cymbal is supported whereby its spacing below the static position of the upper cymbal may be varied as desired, but this adjustment feature in a conventional "high hat" cymbal stand includes a setscrew for loosening and tightening a telescopic connection, thus requiring the utilization of two hands and an appreciable time interval to affect a lower cymbal height adjustment. Accordingly, it is impossible for a drummer, when using a conventional "high hat" cymbal stand, to adjust the static vertical spacing between the upper and lower cymbals of his "high hat" cymbal stand during periods he is playing drums or the cymbals with his hands.

Accordingly, a need exists for structure whereby the static vertical spacing between upper and lower cymbals of a "high hat" cymbal stand may be momentarily adjusted by a drummer and in a manner not requiring the use of the drummer's hands.

Examples of various different forms of cymbal stands incorporating different forms of adjustment features are disclosed in U.S. Pat. Nos. 2,417,972, 3,299,765, 3,464,305, 3,530,757, 3,548,068, 4,145,951 and 4,216,696.

BRIEF DESCRIPTION OF THE INVENTION

The "high hat" cymbal stand of the instant invention incorporates structure whereby the static vertical spacing between upper and lower cymbals thereof may be momentarily adjusted by a drummer independent of the use of either hand. The desired adjustment may be made by the same foot of the drummer which usually actuates the treadle portion of the cymbal stand and therefore does not interfere with hand-manipulation of drumsticks by the drummer.

The main object of this invention is to provide a "high hat" cymbal stand incorporating structure whereby the static vertical spacing between the upper and lower cymbals of the stand may be adjusted independent of the use of a drummer's hands.

Another object of this invention is to provide a static spacing cymbal adjustment in accordance with the preceding object and which may be actuated by utilization of the foot of the drummer normally used to actuate the treadle assembly of the associated "high hat" cymbal stand.

A final object of this invention to be specifically enumerated herein is to provide an apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
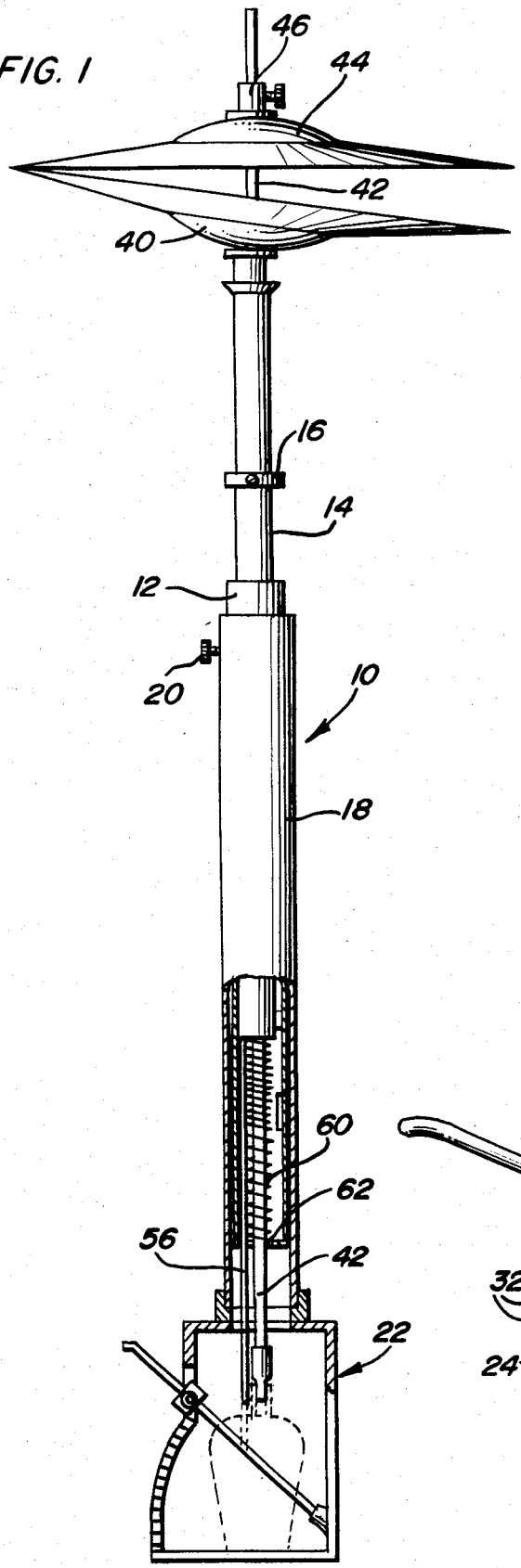
FIG. 1 is a rear elevational view of a "high hat" cymbal stand constructed in accordance with the present invention and with lower portions of the stand being broken away and illustrated in vertical section.
Figure 3:
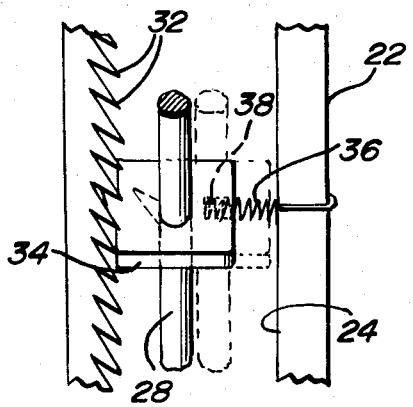
FIG. 3 is a fragmentary side elevational view of the ratchet incorporating adjusting mechanism of the stand.
Figure 2:
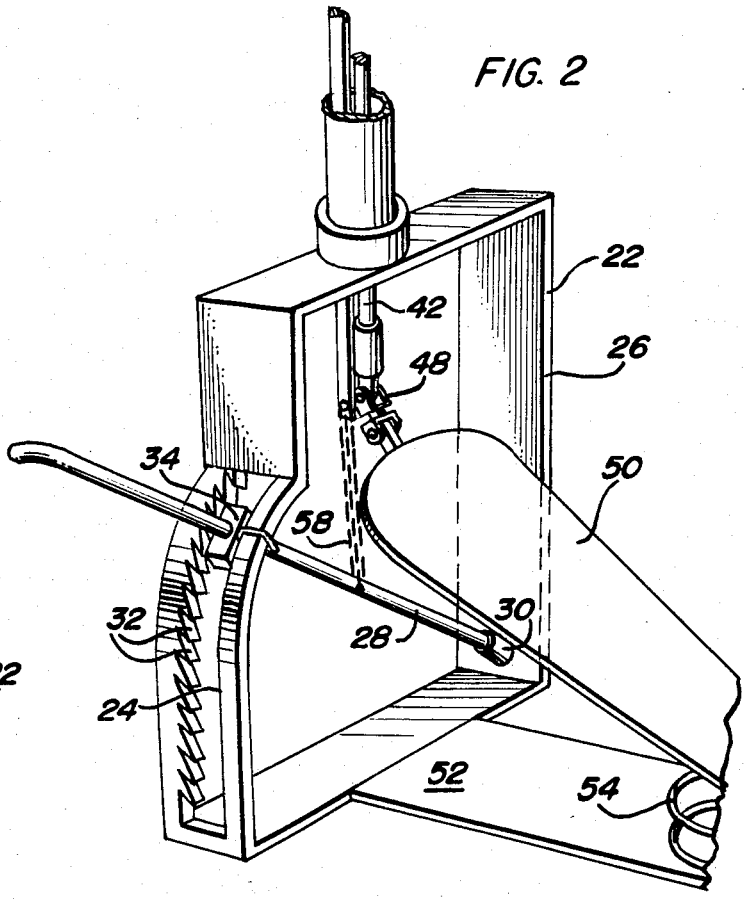
FIG. 2 is a fragmentary perspective view of the lower end portion of the stand illustrated in FIG. 1 and with the near side wall of the base housing portion of the stand removed.

Referring now more specifically to FIGS. 1–4 of the drawings, there may be seen a first form of "high hat" cymbal stand constructed in accordance with the present invention. The stand 10 includes a first upright tubular member 12 downwardly into whose upper end a second tubular member 14 is slidingly telescoped. The second tubular member 14 includes a setscrew equipped collar 16 adjustably mounted thereon and the collar 16 is downwardly abuttingly engageable with the upper end of the tubular member 12 to limit downward sliding movement of the second tubular member 14 within the first tubular member 12. The first tubular member 12 is downwardly telescoped into the upper end of a cylindrical housing 18 equipped with a setscrew 20 for releasably retaining the first tubular member 12 in adjusted upward extended positions relative to the housing 18. The lower end of the housing 18 is supported from a base assembly referred to in general by the reference numeral 22 and the base assembly 22 opens upwardly into the lower end of the housing 18. One side wall portion of the base assembly includes a slot 24 formed therein and the opposite side wall 26 of the base assembly 22 has one end of an adjusting lever 28 pivotally supported therefrom as at 30. The free end of the lever 28 is slidably received in the slot 24 and one side of the slot 24 includes longitudinally spaced downwardly inclined ratchet teeth 32 with which a toothed follower 34 mounted on the lever 28 is engageable. A compression spring 36 has one end thereof guidingly engaged with the side of the slot remote from the teeth 32 and the other end thereof seated in a recess 38 provided therefor in the follower 34. Accordingly, the compression spring 36 yieldingly biases the follower 34 into engagement with the teeth 32.

The upper end of the second tubular member 14 has a lower upwardly facing cymbal 40 supported therefrom for limited universal canting relative to the second tubular member 14 and the center portion of the cymbal 40 is apertured and loosely receives a rod 42 therethrough which projects above the second tubular member 14 and also downwardly below the latter and into the base assembly 22. The upper end of the rod 42 has an upper downwardly opening cymbal 44 adjustably mounted thereon by a setscrew equipped collar 46 and the lower end of the rod 42 is connected by a linkage assembly 48 to the free vertically swingable end of a foot treadle 50 pivotally mounted at its base end from a lateral support 52 projecting outwardly from one side of the base assembly 22. A compression spring 54 serves to yieldingly upwardly bias the free end of the foot treadle 50, the rod 42 and the cymbal 44 to the adjusted upper static position of the latter.

A vertical rod 56 is disposed within the lower portion of the first tubular member and has its upper end anchored relative to the second tubular member 14. The lower end of the rod 56 projects downwardly into the base assembly 22 and is connected by a chain 58 to the lever 28, whereby downward swinging of the free end of the lever 28 will effect a downward pull on the rod 56 and thus downward shifting of the second tubular member 14. A compression spring 60 is disposed about the rod 42 and has its upper end abutted against the lower end of the second tubular member 14 and its lower end downwardly abutted against the apertured lower end wall 62 of the first tubular member 12 through which the rod 42 is slidably received. Thus, the spring 60 exerts an upwardly biasing thrust on the second tubular member 14.

In operation, assuming that the lever 28 is positioned as illustrated in FIG. 1, the left peripheral portions of the cymbals 40 and 44 lightly touch each other. Of course, if the upper cymbal 44 is adjusted upwardly on the rod 42, there may actually be a vertical spacing between the left peripheral portions of the cymbals 40 and 44. If it is desired to increase the spacing between the cymbals 40 and 44, the free outer end of the lever 28 is engaged by the foot of a drummer and downwardly displaced to the position desired. If the vertical spacing between the central areas of the cymbals 40 and 44 through which the rod 42 is received is to be subsequently decreased, the free end of the lever 28 may be engaged by the foot of the drummer, displaced downwardly to disengage the follower 34 from the teeth 32 and then allowed to swing upwardly under the biasing action of spring 60 until the desired decreased spacing between the center areas of the cymbals 40 and 44 is achieved, after which foot pressure on the actuating lever 28 may be released. Of course, the foot utilized to actuate the lever 28 may comprise the same foot to be used by the drummer in actuating the foot treadle 50. Thus, the static spacing between the cymbals 40 and 44 may be adjusted independent of the hands of the drummer.

The setscrew 20 may be loosened in order to adjust the overall height of the cymbals 40 and 44 and the collar 16 may be adjusted to limit downward shifting of the second tubular member relative to the first tubular member 12.

Figure 4:
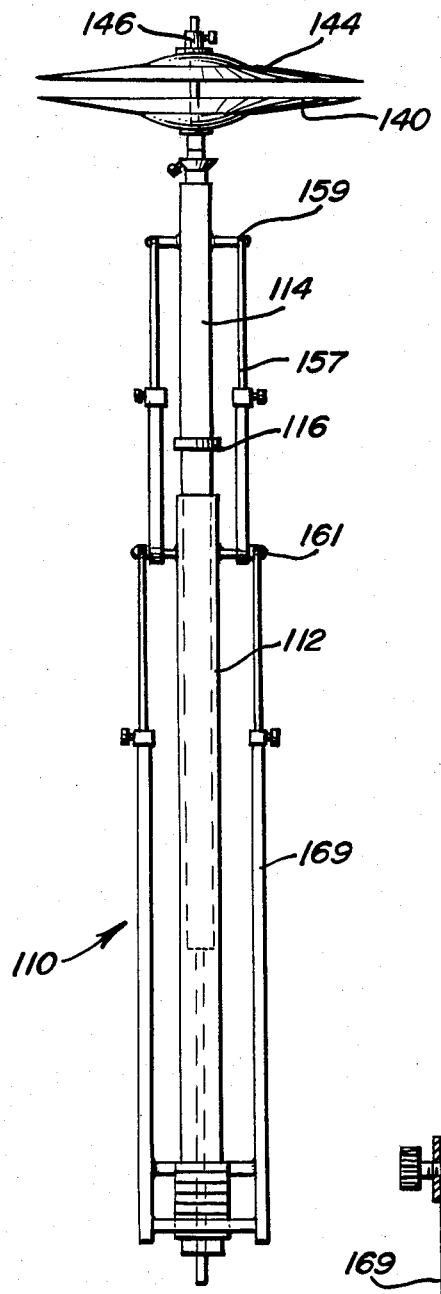
FIG. 4 is a fragmentary rear elevational view of a modified form of "high hat" cymbal stand.
Figure 5:
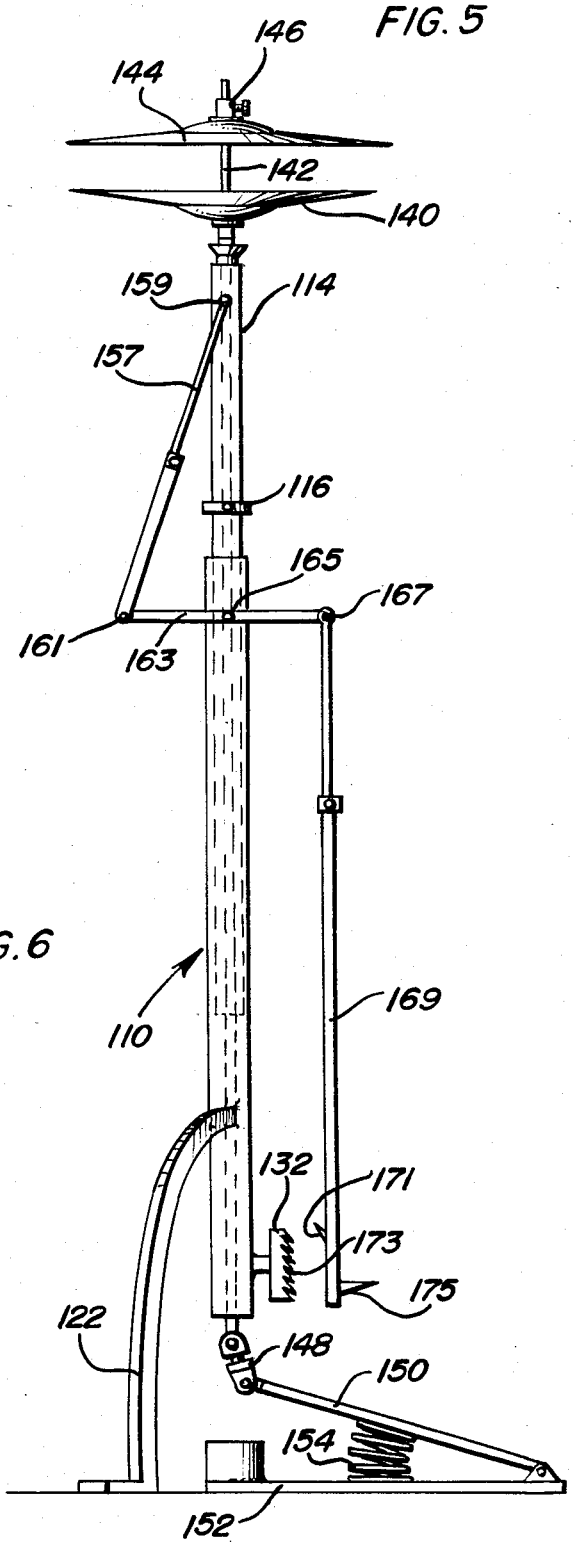
FIG. 5 is a side elevational view of the modified form of cymbal stand illustrated in FIG. 4 and as seen from the right side of FIG. 4.
Figure 6:
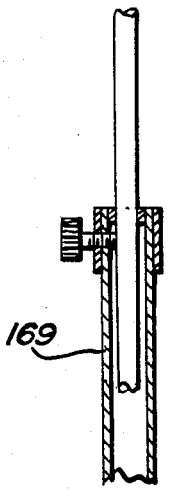
FIG. 6 is a fragmentary vertical sectional view illustrating a setscrew adjustment feature of one of the adjustable length links illustrated in FIGS. 4 and 5.

With attention invited now more specifically to FIGS. 4–6 of the drawings, there may be seen a modified form of "high hat" cymbal stand referred to in general by the reference numeral 110. The stand 110 includes first and second tubular members 112 and 114 corresponding to the members 12 and 14 and a stop collar 116. The lower end of the first tubular member 112 is supported from a base assembly 122 including a toothed rack gear 132 and a rod 142 is slidingly received through the second tubular member 114 and has its lower end connected to a foot treadle 150 by a connecting link 148. A compression spring 154 is disposed between a lateral support 152 and the foot treadle 150 and serves to yieldingly bias the treadle 150, and thus the rod 142 and an upper cymbal 144 supported therefrom, toward an upper static position.

A pair of longitudinally extendable and opposite side links 157 are pivotally connected at their upper ends to diametrically opposite portions of the second tubular member 114 as at 159 and pivotally connected, as at 161, to corresponding ends of a pair of opposite side levers 163 pivotally supported at their longitudinal mid-portions from diametrically opposite sides of the first tubular member 112 as at 165. The other ends of the levers 163 are pivotally connected as at 167 to the upper ends of a pair of longitudinally adjustable links 169 between whose lower ends a ratchet tongue 171 is supported. The ratchet tongue is engageable with the downwardly and outwardly inclined teeth 173 of the ratchet gear 132 and the lower ends of the links 169 further have a foot engageable portion 175 supported and projecting outwardly therefrom above the foot treadle 150.

The upper end of the second tubular member 114 supports a lower upwardly facing cymbal 140 corresponding to the cymbal 40 and gravity tends to overcome the weight of the extendable links 169 and to thereby yieldingly bias the second tubular member 114 and the lower cymbal 140 downwardly relative to the first tubular member 112. However, the ratchet tongue 171 is engageable with the teeth 173 to prevent such downward movement.

It may therefore be appreciated that the cymbal stand 110 functions in generally the same manner as the cymbal stand 10 in that the foot engageable portion 175 may be manipulated by the foot of an associated drummer to vary the height of the center portion of the upwardly facing cymbal 140 relative to the center portion of the upper cymbal 144. Downward pressure on the foot engageable portion 175 decreases the spacing between the cymbals 140 and 144 and downward and outward pressure on the foot engageable portion 175 and subsequent release of downward pressure thereon will allow downward movement of the second tubular member 114 relative to the first tubular member 112 and thus increase the spacing between the cymbals 140 and 144.

It may thus be seen that downward pressure on the actuating lever 28 causes the spacing between the cymbals 40 and 44 to be increased while downward pressure on the foot engageable portion 175 will cause the vertical spacing between the cymbals 140 and 144 to be decreased. Further, the upper cymbal 144 is adjustably mounted in position on the rod 142 by a setscrew equipped collar 146 corresponding to the collar 46.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A cymbal support stand including an upright first tubular member having base means at its lower end for support of said first tubular member from a horizontal surface, a second upright tubular member slidably telescoped in said first tubular member and including an upper end projecting above the upper end of said first tubular member, a lower centrally apertured and upwardly facing cymbal mounted on the upper end of said second tubular member for universal canting relative thereto, an upstanding support rod slidably received through said second tubular member and projecting upwardly through said lower cymbal and above the upper end of said second tubular member, an upper downwardly facing cymbal mounted on the upper end of said rod above and opposing said lower cymbal, means connected between said base means and said rod yieldingly biasing said rod and said upper cymbal toward a static upper position spaced above said lower cymbal, and foot operable means operably connected between said second tubular member and said first tubular member operative to variably stationarily longitudinally position said second tubular member relative to said first tubular member, whereby the vertical spacing between the central areas of said cymbals may be variably adjusted, and foot treadle means operatively connected between said base means and said rod for selectively and variably downwardly displacing said rod, and thus said upper cymbal, relative to said lower cymbal.

2. The cymbal support stand of claim 1 including limit means operatively associated with said first and second tubular members for adjustably limiting downward movement of said second tubular member relative to said first tubular member.

3. The cymbal support stand of claim 1 wherein said foot operable means includes releasable ratchet means for incrementally downwardly displacing said second tubular member relative to said first tubular member responsive to downward foot pressure on a foot engageable operator thereof.

4. The cymbal support stand of claim 1 wherein said foot operable means includes releasable ratchet means operative to incrementally upwardly displace said second tubular member responsive to downward foot pressure upon a foot engageable operator thereof.

5. The cymbal support stand of claim 1 wherein said base means includes a stationary upstanding tubular housing mounted therefrom, said first tubular member being downwardly telescoped in the upper end of said housing and releasably adjustably anchored in longitudinally shifted position therein.

6. The cymbal support stand of claim 1 including limit means operatively associated with said first and second tubular members for adjustably limiting downward movement of said second tubular member relative to said first tubular member, said base means including a stationary upstanding tubular housing mounted therefrom, said first tubular member being downwardly telescoped in the upper end of said housing and releasably adjustably anchored in longitudinally shifted position therein.

7. The cymbal support stand of claim 6 wherein said foot operable means includes releasable ratchet means for incrementally downwardly displacing said second tubular member relative to said first tubular member responsive to downward foot pressure on a foot engageable operator thereof.

8. In a "high hat" cymbal support stand of the type including an upright tubular assembly from whose upper end a centrally apertured lower upwardly facing generally horizontal cymbal is supported for limited universal canting, an upstanding support rod downwardly telescopingly received in said tubular assembly and including an upper end projecting upwardly through said lower cymbal and to a level spaced thereabove, an upper downwardly facing cymbal, mounting means mounting the center portion of said upper cymbal from said rod with said upper cymbal spaced above said lower cymbal, foot treadle means anchored relative to the lower end of said tubular assembly and including a downwardly foot depressible portion, first connecting means operatively connecting said downwardly foot depressible portion with said rod for downwardly displacing the latter responsive to downward movement of said downwardly foot depressible portion, means yieldingly biasing said rod to an upper static position, foot engageable ratchet means mounted to said tubular assembly for vertical shifting relative thereto and second connecting means operatively connecting said ratchet means to said lower cymbal for incrementally upwardly displacing the latter relative to said upper static position of said upper cymbal upon downward displacement of said ratchet means relative to said tubular assembly.

9. The cymbal support stand of claim 8 wherein said means supporting said upper cymbal from said rod includes means operative to adjustably shift said upper cymbal along said rod.

10. The cymbal support stand of claim 8 wherein said second connecting means includes means operative to adjustably vertically shift said lower cymbal relative to said ratchet means.

* * * * *